United States Patent [19]

Coon

[11] 4,009,807

[45] Mar. 1, 1977

[54] GARMENT HANGER

[75] Inventor: Herb Coon, New York, N.Y.

[73] Assignee: Red Wing Products Inc., New Hyde Park, N.Y.

[22] Filed: Dec. 11, 1975

[21] Appl. No.: 639,703

[52] U.S. Cl. ..... 223/96

[51] Int. Cl.[2] ..... A47J 51/14

[58] Field of Search ..... 223/91, 96, 85, 93

[56] References Cited

UNITED STATES PATENTS

| | | | |
|---|---|---|---|
| 648,534 | 5/1900 | Seger | 223/96 |
| 2,496,531 | 2/1950 | Gray | 223/96 |
| 2,522,595 | 9/1950 | Bacica | 223/91 |
| 2,828,898 | 4/1958 | Hulett | 223/96 |
| 3,268,128 | 8/1966 | Hobi | 223/96 |
| 3,570,729 | 3/1971 | Zuckerman | 223/96 |
| 3,767,092 | 10/1973 | Garrison | 223/96 |

FOREIGN PATENTS OR APPLICATIONS

| | | | |
|---|---|---|---|
| 1,210,426 | 9/1959 | France | 223/96 |

*Primary Examiner*—George H. Krizmanich
*Attorney, Agent, or Firm*—Kenyon & Kenyon Reilly Carr & Chapin

[57] ABSTRACT

The garment hanger is formed with a single cross bar having clips at each end which clamp and center a garment directly beneath the cross-bar of the hanger. Each clip has one jaw integrally formed with the cross-bar in an offset manner and a second jaw which pivots on a rib on the first jaw. A spring biases the two jaws together at their clamping ends.

11 Claims, 6 Drawing Figures

GARMENT HANGER

This invention relates to a hanger and particularly to a garment hanger.

As is known, various types of hangers have been used to hang garments such as from clothes racks in retail stores. In many cases, in order to secure a garment such as a skirt, slacks or pants on a hanger, clips have been used to positively hold the garment on the hanger. In some instances, the hangers have been made in a closed loop configuration with a wire cross-bar on which a pair of clips are mounted to engage a garment. The clips used on such hangers have frequently been of a type as described in U.S. Pat. No. 3,456,262. Also, such pairs of clips have been adjustable in relative position one to another along the length of the wire cross-bar in order to accommodate different size garments, and to permit movement of the clips apart from one another so that a garment can be held taut on the hanger.

The manufacture of a hanger with adjustable clips as described above has generally been relatively costly as the clips must first be individually assembled, then assembled onto a wire rod, and then the wire rod must be assembled into a garment hanger body. Thus, not only is the assembly time-consuming, but also a multiplicity of different assembly operations are required. This leads to increased labor and material costs. As a result the clip-type hangers which have been available have been relatively expensive.

Hangers have also been suggested which use built-in clamping devices, such as a hanger with a top-hinged clamping device which snaps closed on the garment. However, such hangers generally do not securely hold garments of different thicknesses. Further, because the operation of these devices is usually unfamiliar to a customer and/or a clerk in a retail outlet, garments are frequently not hung properly. As a result, the garments may fall to the floor and become soiled or, in some cases, may hang in an uneven or untidy manner and cause an unattractive appearance to a rack of garments.

Accordingly, it is an object of the invention to provide a hanger of relatively inexpensive construction for securely holding garments in place.

It is another object of the invention to provide a hanger which securely holds garments of different thicknesses.

It is another object of the invention to provide a hanger of the clip-type which centers a garment beneath the cross-bar of the hanger.

It is another object of the invention to provide a hanger which can be assembled in a simple manner.

It is another object of the invention to provide a hanger of simple construction which can be readily used by a customer and/or clerk in a retail outlet.

Briefly, the invention provides a hanger of simple construction which can hang a garment in a centered manner. The hanger comprises an elongated cross-bar and a pair of clips. Each clip is disposed at a respective end of the cross-bar and includes a pair of jaws and a spring biasing the jaws together. One jaw of each clip is formed integrally with the cross-bar while the other jaw is mounted on the first jaw in abutting pivotal relation on the first jaw and held in place by the spring.

A hook or other hanging means for suspending the hanger is also disposed intermediately of the cross-bar to permit hanging from a clothes rack or the like.

In order to clamp a garment in centered relation beneath the cross-bar, one of the jaws of each clip is disposed in offset relation to the cross-bar and gripping means are provided on the lower end of each jaw with each pair of opposed gripping means being positioned to engage each other in the projected vertical plane of the cross-bar when the hanger is in use.

In order to permit pivoting of the jaws of each clip, a rib is molded or otherwise formed on one jaw while the other jaw has a groove which receives the rib. The molded-in rib acts as a pivot for the other jaw, enabling the clip to open to a very wide opening to accommodate thick garments such as men's trousers.

The spring which biases the two jaws together is formed of a generally U-shaped construction and fits into recesses in the two jaws while straddling the pivot rib. During assembly, using a fixture, the jaw with the groove is placed into position to receive the integrally molded jaw with the rib. The spring for the clip is then initially snapped over the pivot rib and the assembly, i.e., both jaws and spring are held securely in place. The rib thus serves to hold the spring in place while the spring secures the two jaws in position until the final assembly step is completed. This final step consists of forcing the spring downward over the jaws until the spring snaps in place.

In order to simplify manufacture, the cross-bar and integral jaw of each clip are made of a plastic material so as to be readily molded in one piece.

These and other objects and advantages of the invention will become more apparent from the following detailed description and appended claims taken in conjunction with the accompanying drawings in which:

Figure 1:
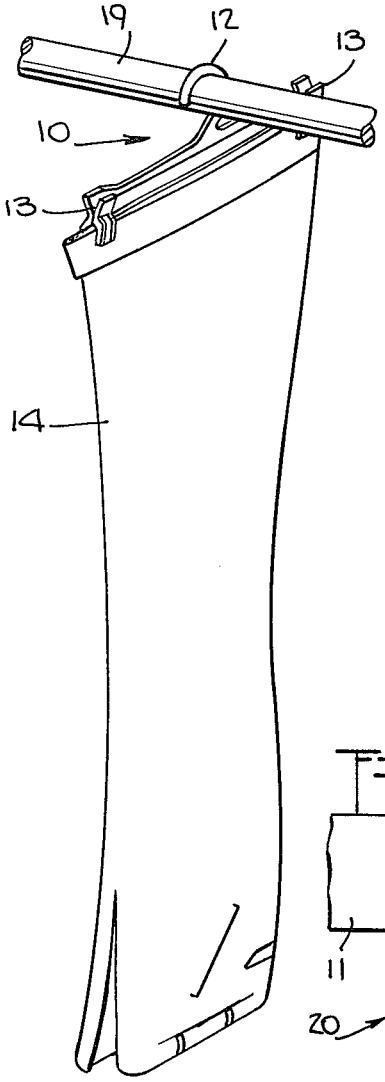
FIG. 1 illustrates a perspective view of a hanger according to the invention supporting a pair of slacks from a clothes rack.

Referring to FIG. 1, the hanger 10 includes a cross-bar 11, a hook 12 and a pair of clips 13 for hanging a garment 14 in centered relation below the cross-bar 11.

Figure 3:
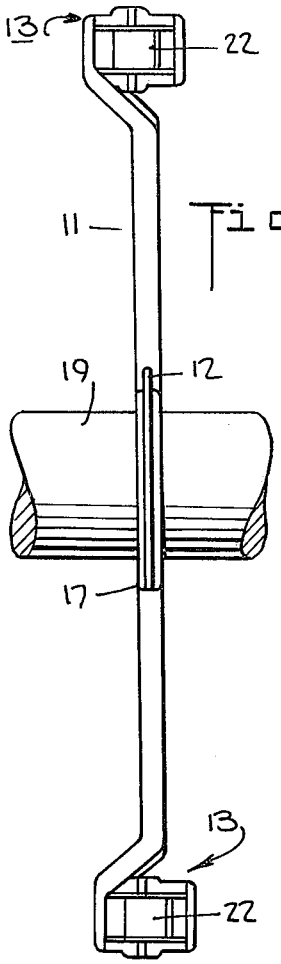
FIG. 3 illustrates a plan view of the hanger of FIG. 1.
Figure 2:
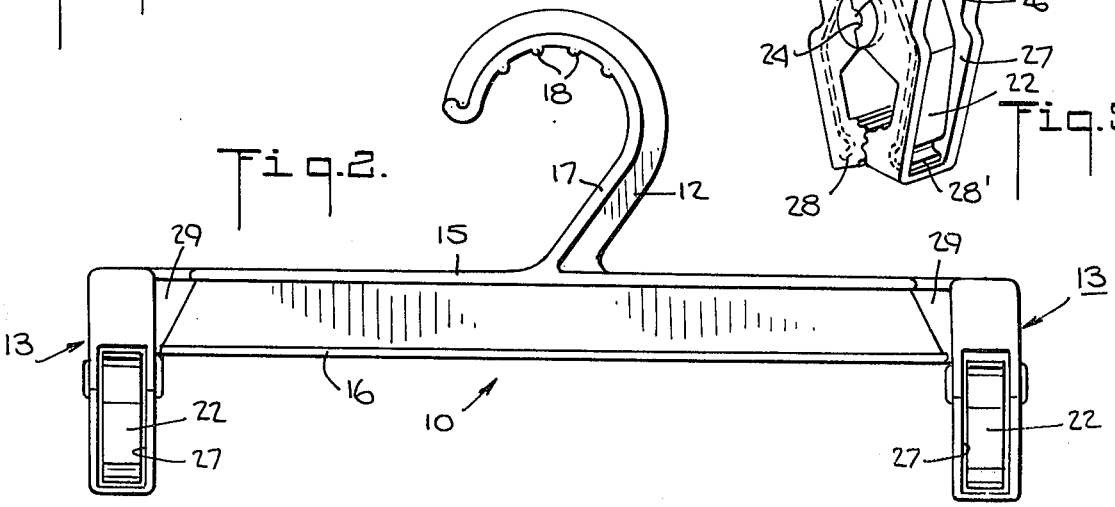
FIG. 2 illustrates a side view of the hanger of FIG. 1.

Referring to FIGS. 2 and 3, the cross-bar 11 of the illustrated embodiment of the invention is of elongated construction with a straight longitudinal axis. In addition, the cross-bar 11 is of I-shaped cross-section with a pair of flanges 15, 16 located along the top and bottom, respectively.

Figure 4:
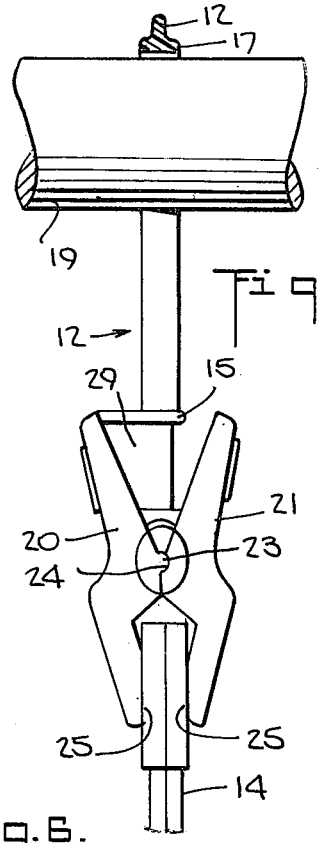
FIG. 4 illustrates a side view of the hanger of FIG. 1.

Referring to FIGS. 2 and 4, the hook 12 is located intermediately of the cross-bar 11 and contains a reinforcing flange 17 along its concave inside which merges into the upper flange 15 of the cross-bar 11. This reinforcing flange 17 also includes a plurality of projections 18 which serve to stabilize the hanger 10 when the hanger is mounted on a rod 19 (FIG. 1) of a clothes rack. These projections 18 also permit the hanger 10 to slide more easily across the clothes rack rod 19. As shown, the flange 17 is of wider dimension that the remainder of the hook 12.

Figure 6:
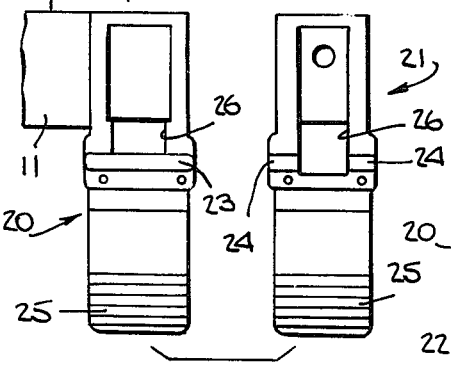
FIG. 6 illustrates a view of the inside surfaces of the jaws.
Figure 5:
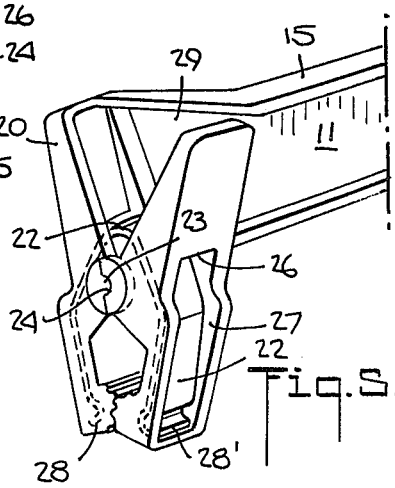
FIG. 5 illustrates a perspective view of one end of a clip-type hanger formed in accordance with the invention.

Referring to FIGS. 1 and 5, the clips 13 are of identical construction and, accordingly, only one clip will hereinafter be specifically described. As shown, each clip 13 includes a pair of jaws 20, 21 and a spring 22 which holds and biases the two jaws 20, 21 together. One jaw 20 is integrally formed with the cross-bar 11 and is disposed in offset relation to the axis of the cross-bar 11. As shown in FIGS. 5 and 6, this jaw 20 depends from the end of the cross-bar 11 and includes a projecting rib 23 which is integrally formed at an intermediate point to extend across the width of the jaw 20. The rib 23 is also located on an axis which is in the projected vertical plane of the cross-bar 11 (FIG. 4). The other jaw 21 is of substantially identical construction but is not integral with the cross-bar 11. Instead, the jaw 21 has a groove 24 formed of two spaced apart portions each located to one side of the jaw 21 which receive the rib 23 of the jaw 20 in mating relation. In this way, the jaw 21 is mounted on the jaw 20 in abutting pivotal relation. The rib 23 and groove 24 are formed so that the jaws 20, 21 of the clip 13 can pivot relative to each other about the axis of the rib 23. In addition, both jaws 20, 21 are formed with enlargements on each side to buttress the groove portions and the rib 23.

Each jaw 20, 21 has a gripping means 25 formed on a lower end. The gripping means 25 are of any suitable construction and are disposed in opposed relation to each other for gripping a garment 14 therebetween (FIG. 1).

The spring 22 of each clip 13 is of generally U-shaped configuration and passes through respective slots 26 in the two jaws 20, 21 so as to straddle the rib 23 and the outside surfaces of the jaws 20, 21. As shown in FIG. 5, each jaw 20, 21 is provided with a recess 27 to accommodate the spring in recessed condition. In this way, the side edges of the spring 22 are not exposed. The spring 22 also has deformed lower portions 28, 28', such as described in U.S. Pat. No. 3,456,262 to fit within suitable recesses (not shown) in the jaws 20, 21 behind the respective gripping means 25.

As shown in FIGS. 2 and 5, the cross-bar 11 has an offset portion 29 at each end which merges into the jaw 20 of each clip 13. In addition, the upper flange 15 of the cross-bar 11 extends into the offset portion 29 to reinforce the offset portion 29; however, the lower flange 16 terminates at the off-set portion 29 without passing into the offset portion 29.

The axes of the ribs 23 of the clip 13 are diposed below the cross-bar 11 in the projected vertical plane of the cross-bar 11 when the hanger is in use. In addition, the mating planes of the gripping means 25 of the clips 13 are disposed in coplanar relation with the rib axes and the axis of the cross-bar 11.

In order to use the hanger 10 the user opens each clip 13 by compressing the upper ends of the jaws 20, 21. This causes the jaws 20, 21 to move apart at the lower ends so that a garment 18 such as a pair of slacks can be inserted therebetween. Upon release of the opening force of the jaws 20, 21, the slacks are securely gripped in place in each clip 13. Thereafter, the hanger 10 can be placed upon the rod 19 of a clothes rack (FIG. 1) with the garment 18 securely held in place. As indicated in FIG. 4, when in place, the entire garment 18 is held, i.e., suspended in a centered condition beneath the cross-bar 11 of the hanger 10.

The invention thus provides a hanger of simple construction which can be manufactured in a relatively simple manner. To this end, the cross-bar 11 includes the offset portion 28, the hook 12 and the integral jaw 20 of each clip can be formed in one piece. For example, when made of plastic material these components can be molded in one piece. Thereafter, using an assembly fixture (not shown), each separately molded jaw 21 with the groove 24 is located on an integrally molded jaw 20 with the groove 24 receiving and mating with a rib 23. A spring 22 is then snapped over the rib 23 to hold the resultant assembly in place. In this condition, the deformed lower portion 28' of the spring 22 abuts against an inclined surface of the separately molded jaw 21 and is biased outwardly. This produces a slight clamping force to be imposed on the two jaws 20, 21 between the rib 23 and groove 24. Finally, the spring 22 is pushed downward over the jaws 20, 21 and snaps into place.

In order to accommodate garments of different widths, the hanger may be manufactured in different sizes.

It is further noted that the rib 23 of each clip allows each clip to be opened to a wide degree so as to receive thick garments.

What is claimed is:

1. A hanger comprising
an elongated cross-bar having an offset portion at each end;
a hook disposed at an intermediate part of said cross-bar; and
a pair of clips mounted on said cross-bar, each said clip being disposed at a respective end of said cross-bar and including a first jaw integrally formed on a respective offset portion of said cross-bar, a second jaw mounted on said first jaw in abutting pivotal relation to said first jaw, each jaw of each clip including a gripping means at one end facing an opposed gripping means of the other jaw of each clip, said oppositely disposed gripping means being located symmetrically of the plane of said cross-bar and a spring biasing said jaw together, said spring being disposed to straddle said jaws.

2. A hanger as set forth in claim 1 wherein said first jaw of each clip includes an integral rib and said second jaw of each clip includes a groove receiving said rib to permit pivoting of said second jaw about said rib.

3. A hanger as set forth in claim 1 wherein said first jaw is offset relative to the longitudinal axis of said cross-bar.

4. A hanger comprising
an elongated cros-bar having a longitudinal axis;
a hook disposed intermediately of said cross-bar; and
a pair of clips mounted on said cross-bar, each said clip having a pair of jaws biased towards each other to clamp a garment therebetween to suspend the entire garment in centered relation beneath said cross-bar, one of said jaws of each clip being integrally formed with said cross-bar with one jaw of each pair of clips including a rib disposed on the same plane as said axis of said cross-bar and the other jaw of each pair of clips including a groove receiving said rib to permit pivoting of said jaws relative to each other about said rib and with each jaw of each clip including a gripping means at one end facing an opposed gripping means of the other jaw of each clip, said oppositely disposed gripping means being located symmetrically of the plane of said cross-bar.

5. A hanger comprising an elongated cross bar having a longitudinal axis and an offset portion at each end;

an upstanding hook intermediately of said cross-bar; and a pair of clips mounted on said cross-bar, each said clip being disposed at a respective end of said cross-bar and including a first jaw integrally formed on a respective offset portion of said cross-bar and disposed in offset relation to said axis of said cross-bar, a second jaw pivotally mounted on said first jaw to clamp a garment therebetween to suspend the entire garment in centered relation beneath said cross-bar, and a spring biasing said jaws together.

6. A hanger as set forth in claim 5 wherein one jaw of each pair of jaws includes a rib and the other jaws of each pair of clips includes a groove receiving said rib to permit pivoting of said jaws relative to each other about said rib.

7. A hanger as set forth in claim 6 wherein each jaw of each clip includes a gripping means at one end facing an opposed gripping means of the other jaw of each clip, said oppositely disposed gripping means being located symmetrically of the plane of said cross-bar.

8. A hanger as set forth in claim 7 wherein the axis of said rib of each clip is disposed in the same plane as said axis of said cross-bar and the mating plane of said gripping means of each clip.

9. A hanger as set forth in claim 7 wherein the axis of said rib of each clip is disposed in the same plane as said axis of said cross-bar.

10. A hanger as set forth in claim 5 wherein said cross-bar, said hook and said first jaw of each clip are integrally formed in one-piece.

11. In a hanger the combination comprising a hanging means to suspend the hanger;

an elongated cross bar having a longitudinal axis and an offset portion at each end; and a pair of clips mounted on said cross-bar, each said clip being disposed at a respective end of said cross-bar and including a first jaw integrally formed on a respective offset portion of said cross-bar and disposed in offset relation to said axis of said cross-bar, a second jaw pivotally mounted on said first jaw to clamp a garment therebetween in centered relation beneath said cross-bar, and a spring biasing said jaws together.

* * * * *